US006000249A

United States Patent [19]

Wilber

[11] Patent Number: 6,000,249

[45] Date of Patent: Dec. 14, 1999

[54] PRISONER RESTRAINT DEVICE AND METHOD THEREFOR

[76] Inventor: Daniel G. Wilber, 5221 Rte. 212, Mt. Tremper, N.Y. 12457

[21] Appl. No.: 09/104,018

[22] Filed: Jun. 24, 1998

[51] Int. Cl.[6] ..... E05B 75/00

[52] U.S. Cl. ..... 70/16; 119/857

[58] Field of Search ..... 70/16, 17, 15, 70/14, 18; 224/914; 128/878, 869, 870, 871, 872, 873, 874, 875, 876; 119/856, 857, 769, 770; 482/105; 602/19, 32, 36, 40

[56] References Cited

U.S. PATENT DOCUMENTS

| | | | |
|---|---|---|---|
| 583,796 | 6/1897 | Ferrell . | |
| 2,998,008 | 8/1961 | Klesa | 128/878 |
| 3,007,331 | 11/1961 | Irwin . | |
| 3,616,665 | 11/1971 | Rosenthal . | |
| 3,740,977 | 6/1973 | Stefansen et al. | 70/16 |
| 3,751,031 | 8/1973 | Yamauchi | 482/105 |
| 4,509,346 | 4/1985 | Szczepanek | 70/16 |
| 4,741,051 | 5/1988 | Bible | 70/16 |
| 4,840,048 | 6/1989 | Elam | 70/16 |
| 4,949,679 | 8/1990 | Wolfer | 128/878 |
| 5,007,257 | 4/1991 | Thompson | 70/16 |
| 5,463,885 | 11/1995 | Warren, Sr. | 70/18 |
| 5,551,447 | 9/1996 | Hoffman et al. | 70/16 |
| 5,613,381 | 3/1997 | Savage | 70/16 |
| 5,680,781 | 10/1997 | Bonds et al. | 70/16 |
| 5,732,576 | 3/1998 | Moore et al. | 70/16 |

*Primary Examiner*—Suzanne Dino Barrett
*Attorney, Agent, or Firm*—Schmeiser, Olsen & Watts

[57] ABSTRACT

A prisoner restraint device is provided having a belt with a tongue attached to a handcuff cover with two plates with inner and outer faces, lateral edges, longitudinal edges and slots. A channel to receive a portion of a pair of handcuffs extends across each of the inner faces of the plates from one lateral edge to the other lateral edge. The plates may be secured together with locking mechanisms and/or by using a sleeve containing slots corresponding to the slots of the plates and inserting a tongue through the slots. One end of the tongue is attached to a belt, further restricting the prisoner's ability to move his hands relative to his body.

4 Claims, 6 Drawing Sheets

PRISONER RESTRAINT DEVICE AND METHOD THEREFOR

BACKGROUND OF THE INVENTION

1. Field of the Invention

This invention relates generally to devices used by law enforcement personnel to restrain prisoners and other subjects, and more specifically relates to a prisoner restraint and a method therefor to improve the restraint of a subject.

2. Description of Related Art

In law enforcement and related fields, it is often necessary to restrain individuals. While some individuals may be relatively compliant and require little in the way of physical restraint, many individuals are likely to attempt to escape and/or to do physical harm to those around them. These latter individuals may require substantial physical restraints to be safely kept in custody. This need for physical restraints is particularly acute when an individual is transported or is first apprehended.

Perhaps the single most common method of physically restraining such an individual is handcuffs. A typical set of handcuffs includes two wristlets joined by a chain. The wristlets are locked around the wrists of the subject. Typically the wristlets are unlocked using a key.

While handcuffs are a useful form of restraint, they often fail to restrain the prisoner as fully as might be desired. Prisoners wearing handcuffs may succeed in accessing the locks on the wristlets and picking them, thereby escaping from the handcuffs. A prisoner may break the chain joining the wristlets on rocks or other hard surfaces so that, even without the wristlets removed, the prisoner will have full use of his hands. Even if the prisoner cannot open the wristlets or break the chain, the handcuffs allow him to move his hands a considerable distance relative to his body and to move his hands relative to one another as far as the chain between the wristlets permits. This range of movement may allow the prisoner to grab a weapon or a tool. Even if no weapon or tool is available to the prisoner, he may take advantage of his range of movement by striking or grabbing those around him. For these reasons, handcuffs used alone often fail to adequately secure a subject.

One prior art device is U.S. Pat. No. 3,740,977 to Stefanson. This device includes a cover assembly for enclosing conventional handcuffs. A difficulty with this device is that the lock 56 for belly chain 54 as shown in FIG. 5 may be easily accessed by a prisoner's hands. The lock 56 may be easily accessed because both ends of the belly chain 54 are attached proximate the handcuff cover 10 and the prisoner's hands. Furthermore, release of the lock 56 would permit the belly chain 54 to be released.

Therefore, the need exists for a device to prevent a prisoner from accessing the locks on the belt while additionally restricting a prisoner's hand movements relative to each other and to his body. Such a device must be easy to use and capable of rapid securement. While the prior art devices and methods aid in preventing a prisoner from accessing the locks on handcuff wristlets and restrict the movement of the prisoner's hands, they do not prevent access to locks on the belt while securing a handcuff cover to the belt, they are generally difficult to use, and require an inordinate amount of time to secure properly.

SUMMARY OF THE INVENTION

The present invention is used in conjunction with typical handcuffs to provide enhanced security in restraining a subject. The invention provides a cover that partially encloses a pair of handcuffs such that the subject may not access the key holes on the wristlets and a belt insertable into the cover and locked thereto. The invention also limits the subject's ability to move his hands relative to his body and each other. The invention is significantly easier to use than the prior art. The invention accomplishes this improvement by attaching a handcuff cover to a belt using a tongue that is connected to the belt on one end, the other end being inserted through a slot of the cover. This allows the subject's hands to be secured within the cover as a step separate from securing the belt around the subject's waist. The method is also safer for attachment to a prisoner with fewer steps. Once the handcuffs are attached, the handcuffs' cover and belt may be quickly attached and locked. Furthermore, the present invention is safer due to the number and location of locks on belt and handcuffs to prevent prisoner escape.

More particulary, this invention includes: (1) A device for restraining a prisoner comprising: a belt having a first end and a second end; a first lock for coupling the first end to the second end; and a tongue, coupled to the belt between the first end and the second end, wherein the tongue includes an opening therethrough for locking the belt to a handcuff cover; (2) The device further comprising a handcuff cover for coupling to the tongue, and a second lock for insertion through the opening; and (3) The device wherein the tongue is secured to the belt substantially equidistant from ends of the belt.

The foregoing and other features and advantages of the invention will be apparent from the following more particular description of the preferred embodiments of the invention.

BRIEF DESCRIPTION OF THE DRAWINGS

The preferred exemplary embodiment of the present invention will hereinafter be described in conjunction with the appended drawings, where like designations denote like elements, and.

DETAILED DESCRIPTION OF A PREFERRED EXEMPLARY EMBODIMENT

Figure 1:
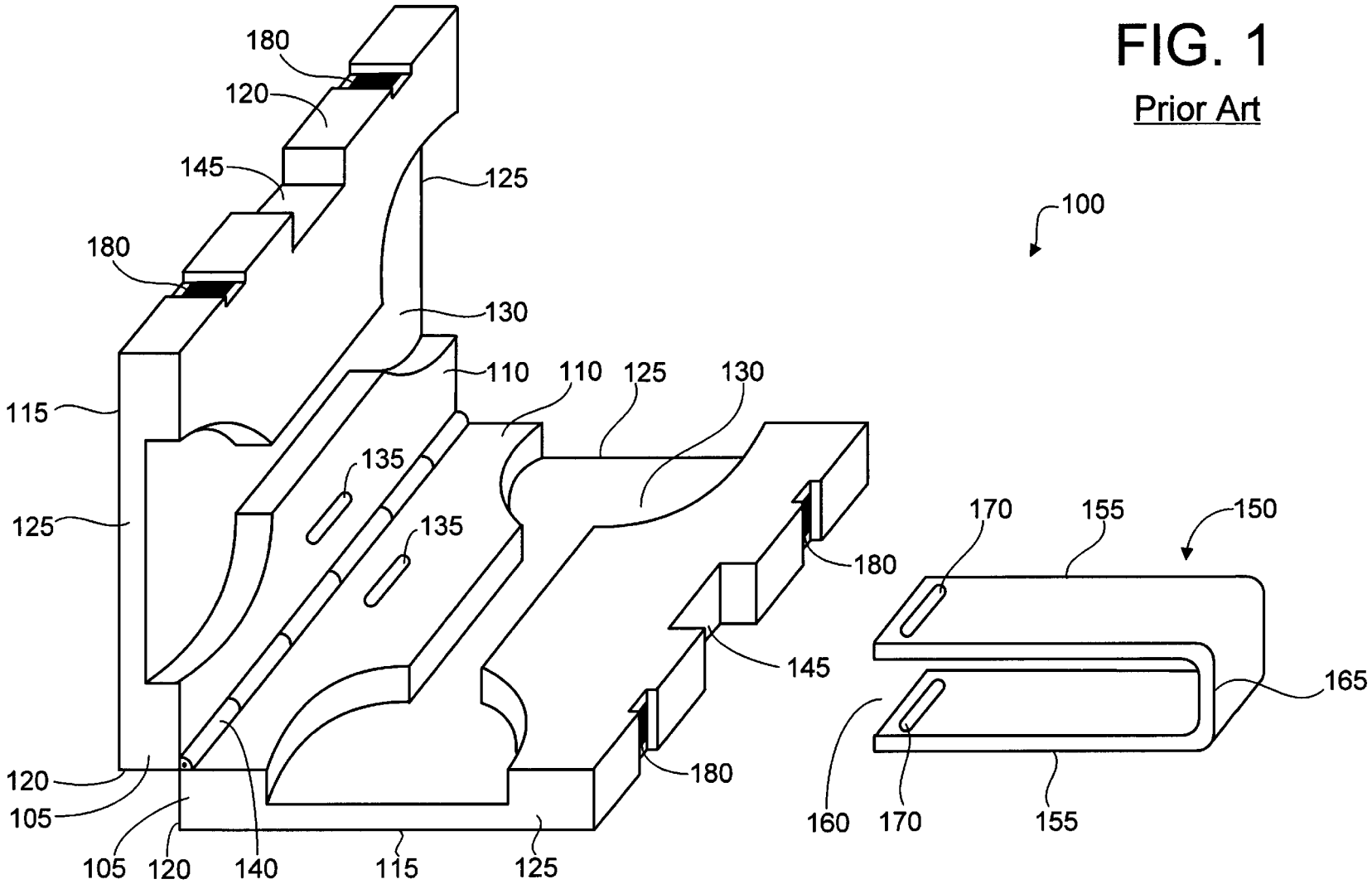
FIG. 1 Prior Art
FIG. 1 is a perspective view of prior art handcuff cover in an open position.

In accordance with the present invention, a prisoner restraint device overcomes the deficiency of handcuffs and handcuffs cover by providing more secure restraint of a prisoner.

Referring now to FIGS. 1, 3, 4, and 5 a prior art handcuff cover 100 and handcuffs 200 are shown. The cover 100 includes two plates 105. Each plate 105 possesses an inner face 110, an outer face 115 and four edges. The four edges include two longitudinal edges 120 and two lateral edges 125. The inner face 110 of each plate 105 contains a channel 130 extending from one lateral edge 125 to the other lateral edge 125.

The channel 130 is configured to receive a chain 205 of handcuffs 200, and ideally, a portion of the wristlets 210.

Accordingly, the channel 130 is shaped such that the portion of the wristlets 210 containing the keyholes 215 are covered by the plates 105. The channels 130 on the inner faces 110 of the plates 105 are positioned such that when the inner faces 110 of the plates 105 are placed in contact, the two channels 130 are substantially aligned. The channels 130 may be formed to mimic the contours of the handcuffs 200 or may be modified from the prior art shape, such as rectangular which would be able to adequately receive and retain the desired portions of the handcuffs. The width of the channels 130 at their widest point(s) may be equal to or less than the length of the lateral edges 125 of the plates 105.

The channels 130 may be formed in a number of ways other than that shown in the prior art. If the plates 105 are created by casting, the channels 130 may be created during the casting of the plates. If the plates 105 are made from sheet metal, then material (preferably also sheet metal) may be attached to the inner faces 110 of the plates 105 to form the channels 130. In this instance, the material may be attached to the inner faces 110 in any suitable manner, such as using adhesives, welding, rivets or screws. The channels 130 may also be formed by constructing the plates 105 from sheet metal with portions of the sheet metal being folded at the lateral edges 125 and the longitudinal edges 120, with the channel 130 then being the space bounded on two sides by the longitudinal edges 120 and on the other two sides by the lateral edges 125. If desired, the user may choose to provide no metal fold at the lateral edges 125, resulting in a channel 130 as wide as the length of the lateral edges 125. In this prior art device, the channels 130 essentially occupy the entire inner face 110 of each plate 105. To assemble the device 100, the channels 130 must be aligned and the plates 105 joined together as described below.

Each plate also contains at least one slot 135. The slot 135 extends from the outer face 115 to the inner face 110 of each plate 105. In the prior art device, each plate 105 contains one slot 135. The slots 135 are positioned such that when the inner faces 110 of the plates 105 are placed in contact, the slots 135 are substantially aligned. According to the prior art device, the plates 105 are joined along one longitudinal edge 120 by at least one hinge 140. Also according to the prior art device, each longitudinal edge 120 opposite of the hinge 140 contains a groove 145. The groove 145 on the longitudinal edge 120 opposite the hinge 140 of each plate 105 is located such that the grooves 145 are substantially aligned when the inner faces 110 of the plates 105 are placed in contact.

According to the prior art device, the prisoner restraint device 100 includes a sleeve 150. The sleeve 150 is substantially "U" shaped, having two arms 155, an open end 160 and a closed end 165. The open end 160 allows the sleeve 150 to be slid over the two plates 105 when the inner faces 110 are contacted. When the sleeve 150 is placed over the plates 105, the closed end 165 engages the grooves 145 on the longitudinal edges of the plates 105 opposite the hinge 140. The arms 155 also contact the outer faces 115 of the plates 105. The arms 155 each possess one or more slots 170 passing therethrough. When the sleeve 150 is placed upon the plates 105, the slots 170 of the arms 155 are substantially aligned with the slots 135 of the plates 105.

Two locking mechanisms 180 located on the longitudinal edges 120 of each plate 105 opposite of the hinge 140. These locking mechanisms 180 are preferably located on each side of the groove 145, but may be located anywhere on the edges 120, 125 of the plates 105. The locking mechanisms 180 are configured such that they may receive a secondary lock (not shown) which would slide within the mechanism 180 and transverse the plate 105 such that the closing of the secondary lock would further prevent the plates from being separated. Alternatively, the secondary lock could be integral with the plates 105 such that when the inner faces 110 of the plates 105 are placed in contact, the two locking mechanisms 180 on one plate 105 engage the locking mechanisms 180 on the other plate 105 so that the plates may not be opened until the appropriate key (not shown) is used to disengage the locking mechanisms 180. While these locking mechanisms 180 are not strictly necessary to the practice of the invention, their use further enhances the security of the device.

Figure 2:
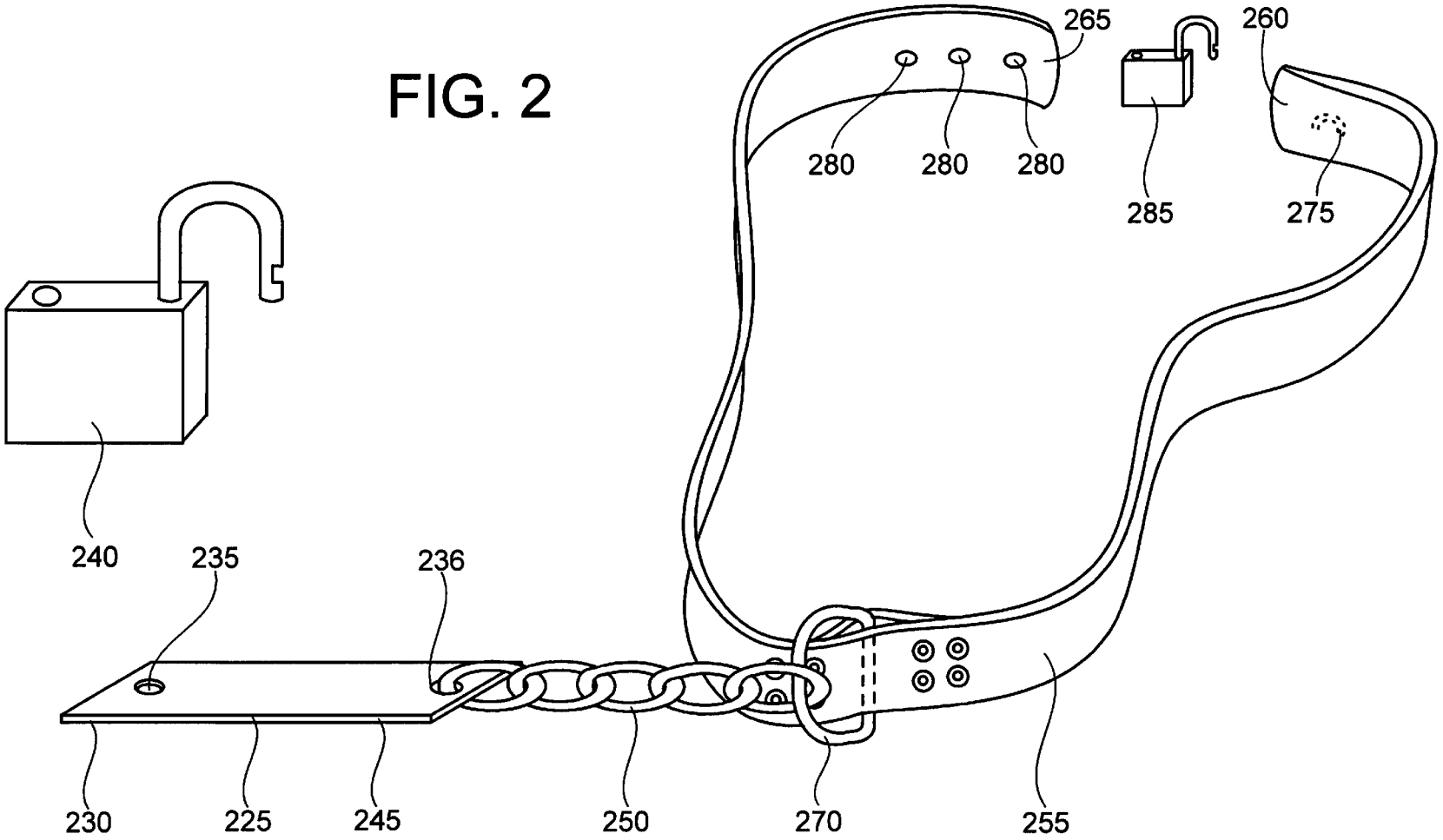
FIG. 2 is a perspective view of a belt of an embodiment of the present invention.
Figure 6:
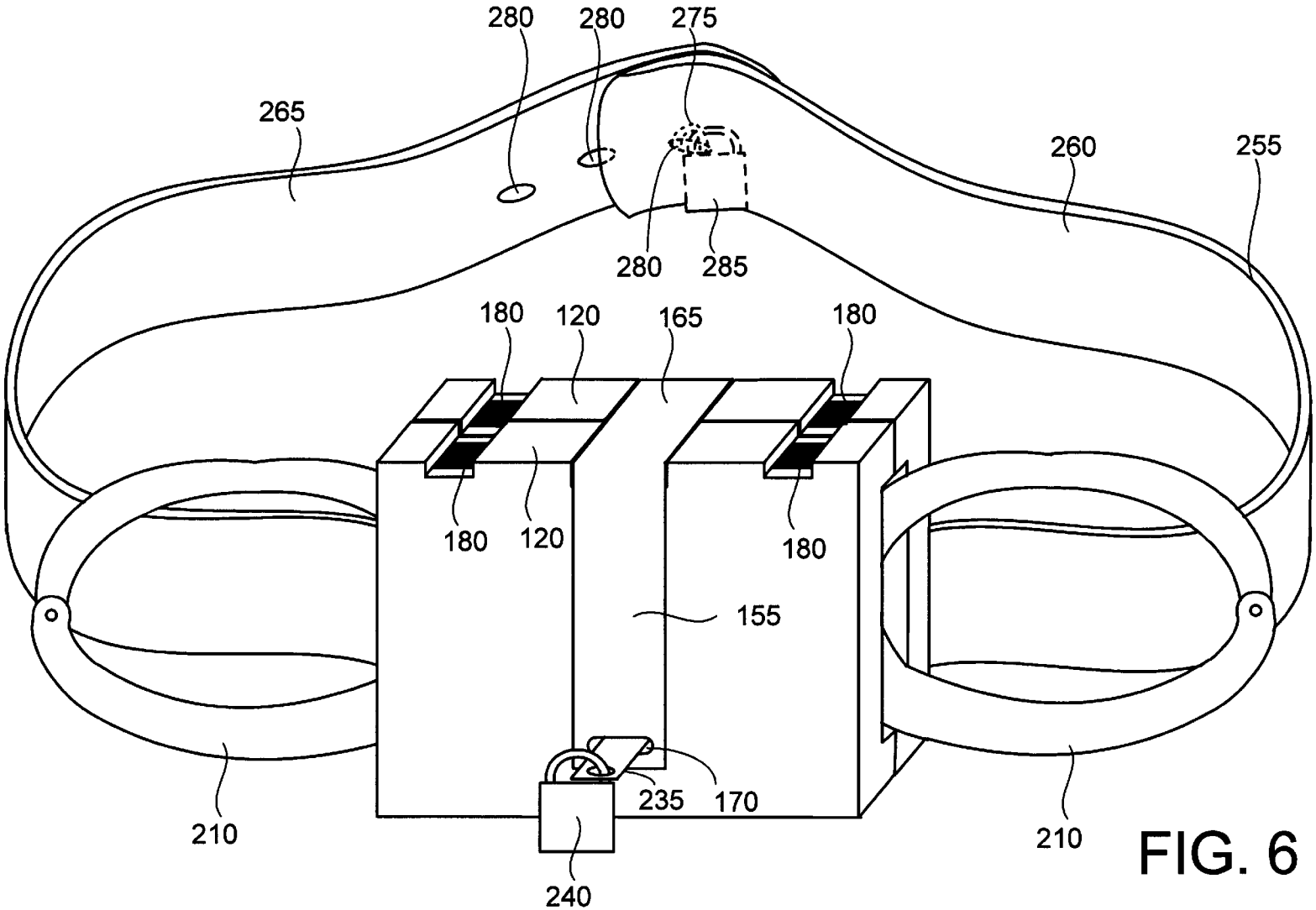
FIG. 6 is a belt attached to a handcuff cover in accordance with an embodiment of the present intention.

Turning to the preferred embodiment as shown in FIGS. 2 and 6, a tongue 225 dimensioned to pass through the slots 135, 170 when the device 100 is assembled is provided. The tongue 225 has a first end 230 and a second end 245. The first end 230 is configured such that it may be rendered temporarily incapable of passing through the slots 135, 170. In the preferred exemplary embodiment this is accomplished by providing an aperture or first opening 235 through which a padlock 240 may be attached, the padlock 240 thus prevents the first end 230 of the tongue 225 from passing through the slots 135, 170. The second end 245 of the tongue 225 is attached to a belt 255. The second end 245 of the tongue 225 may be attached directly to the belt 255 or may be connected to the belt 255 using a chain 250 through a second opening 236. A D-ring 270 may be used to affix the second end 245 of the tongue 225 (or chain 250, if one is used) to the belt 255. The belt 255 has a first end 260 and a second end 265. The belt 255 is secured about the waist of the prisoner to be restrained by wrapping the length of the belt 255 around the waist and securing the first end 260 and the second end 265 together. One skilled in the art will realize that numerous buckles, clasps, snaps and other fasteners may be used to secure the first end 260 and the second end 265 together. According to the preferred embodiment, the first end 260 contains a metal bracket 275 and the second end 265 contains at least one hole 280. To secure the first end 260 and the second end 265 together the bracket 275 is inserted through a hole 280. A padlock 285 is then secured to the bracket 275 to secure the first end 260 and the second end 265 together. Ideally, the first end 260 and the second end 265 are secured together behind the prisoner's back, though this is not necessary for the subject invention to be effective. An advantage of placing the lock 285 behind the back or a distance from the tongue 225 is to prevent easy access thereto by the prisoner.

Figure 3:
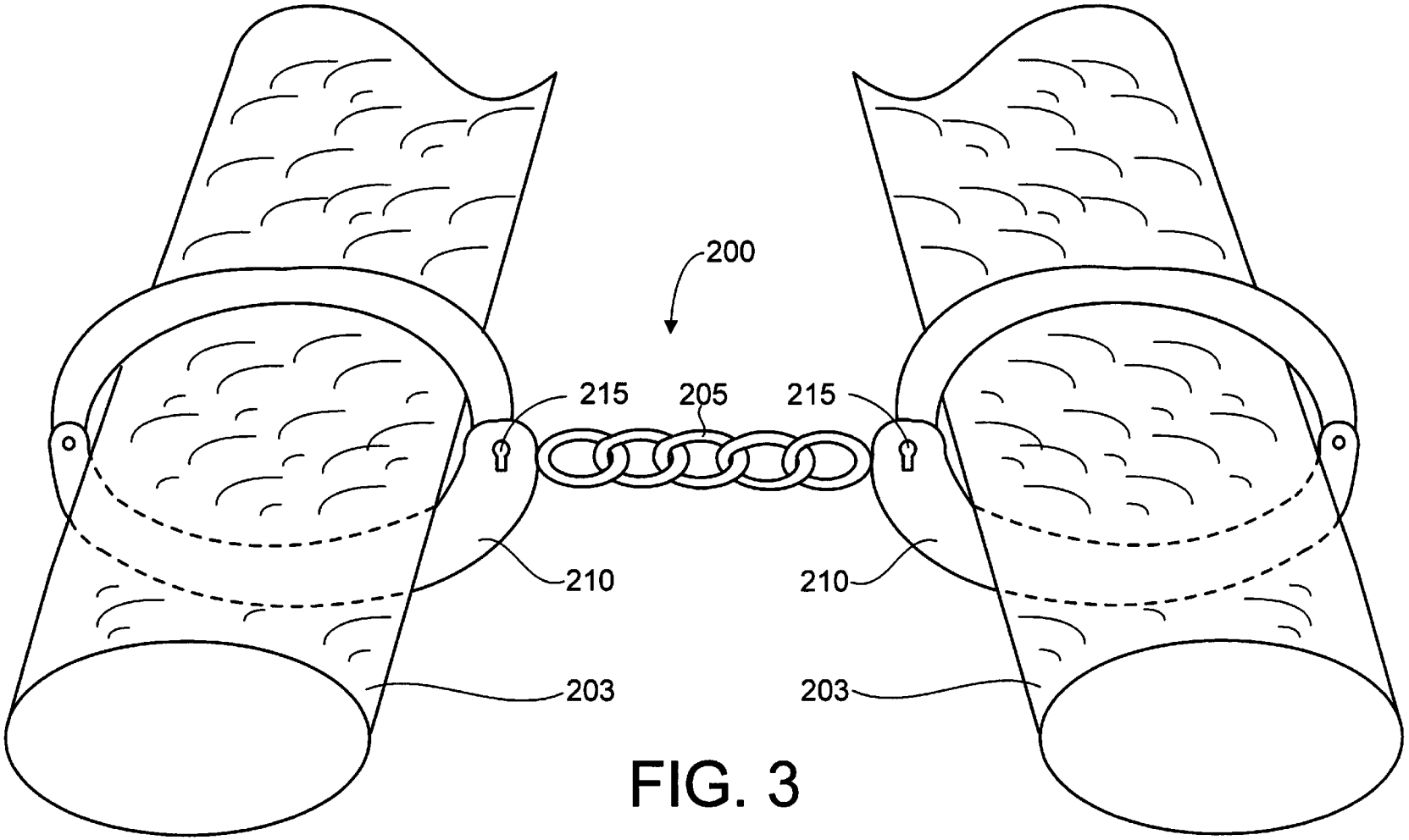
FIG. 3 Prior Art
FIG. 3 is a perspective view of prior art handcuffs.
Figure 4:
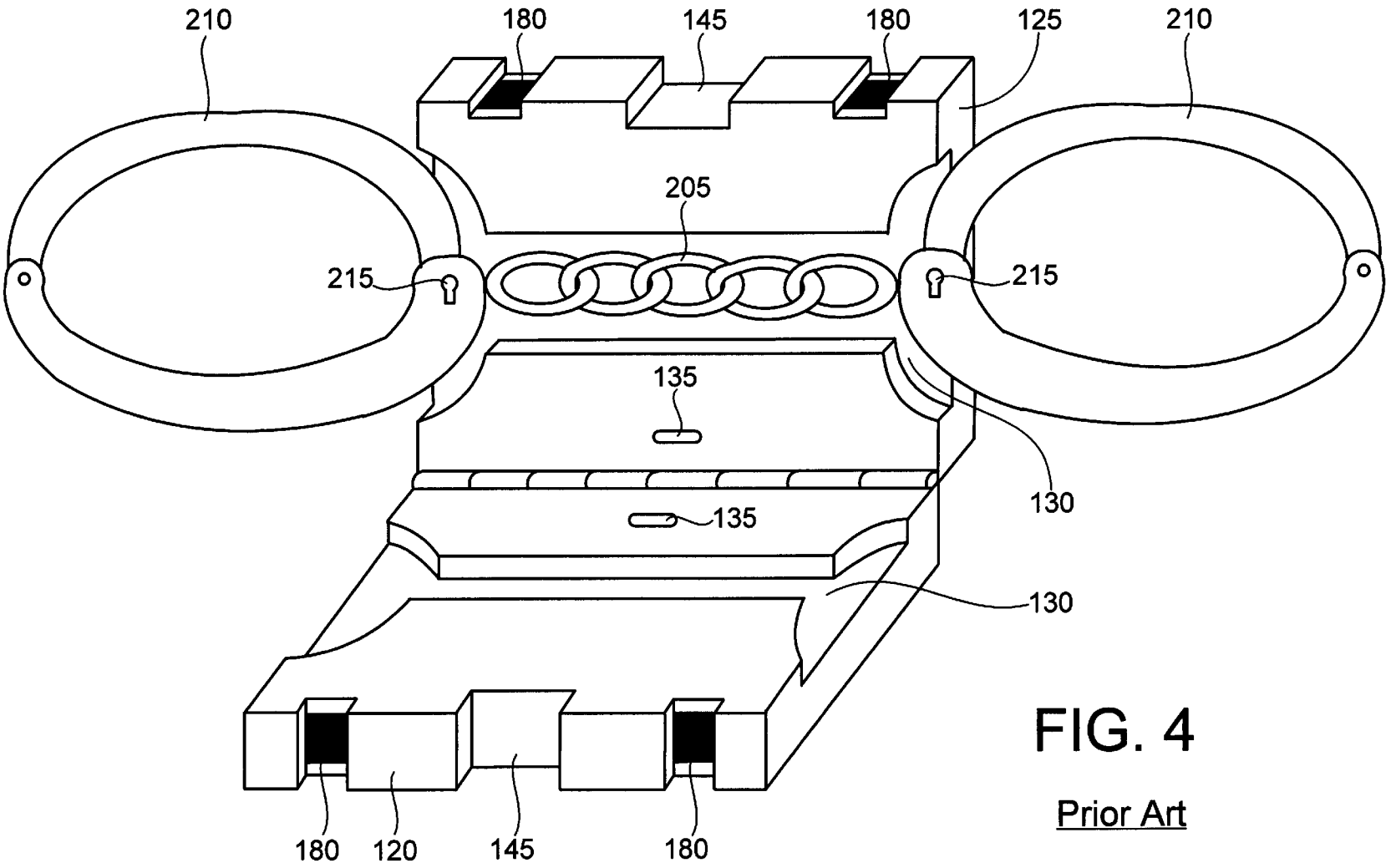
FIG. 4 Prior Art
FIG. 4 is a perspective view of prior art handcuffs and handcuff covers.
Figure 5:
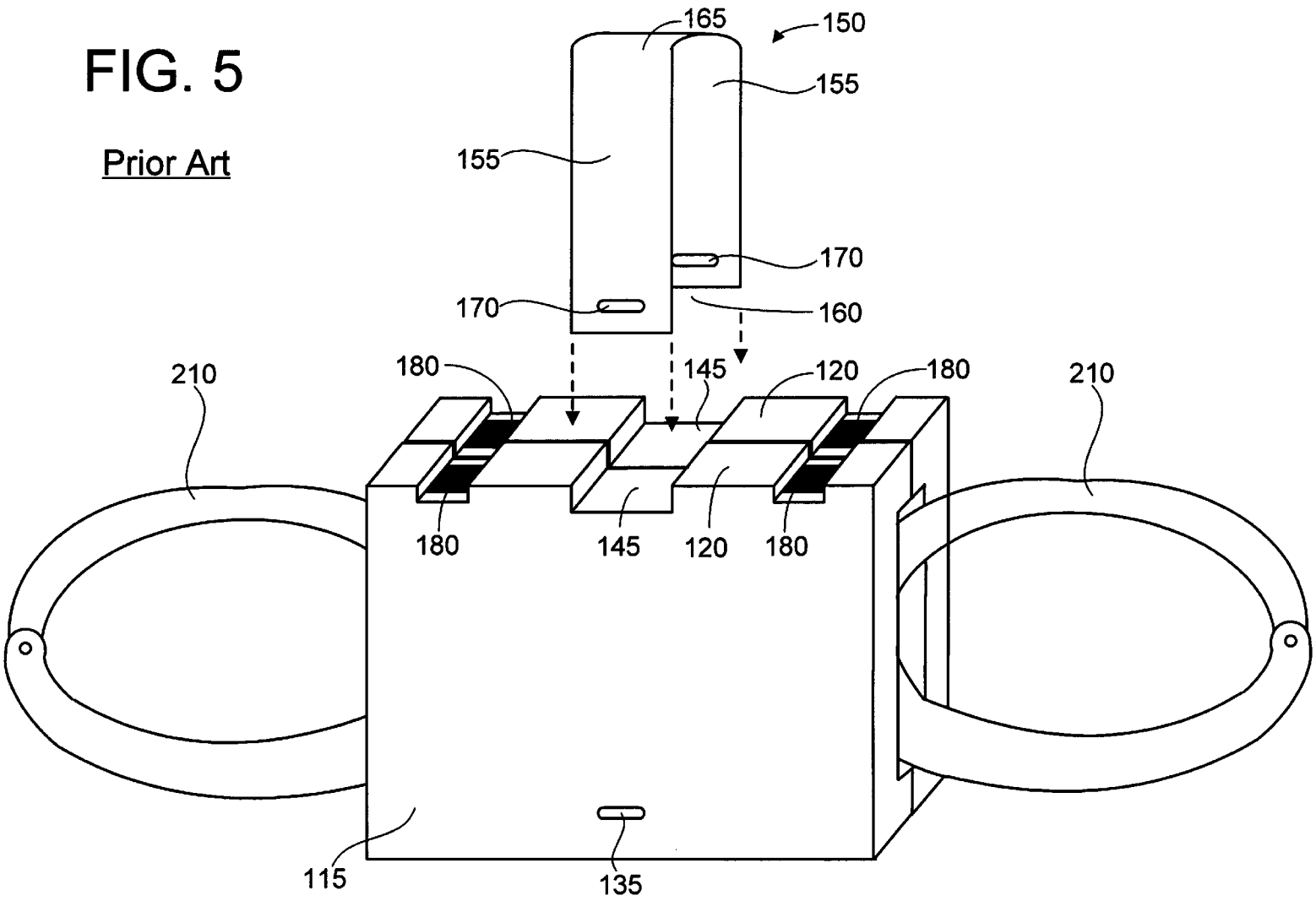
FIG. 5 Prior Art
FIG. 5 is a perspective view of prior art handcuff cover sleeve being inserted.

Referring now to FIGS. 1–3, handcuffs 200 are placed upon the wrists 203 of a prisoner. Chain 205 and, ideally, a portion of the wristlets 210 are then placed in the channel 130 of one plate 105. The other plate 105 then rotates about the hinge 140 until the inner faces 110 of the two plates 105 are in contact. When the inner faces 110 of the plates 105 are placed in contact, the locking mechanisms 180 engage. A portion of the handcuffs 200 is now contained within the plates 105. Keyholes 215 used to release the wristlets 210 are contained within the plates 105. The sleeve 150 is then slid over the plates 105 until the closed end 165 engages the grooves 145 and the slots 170 of the arms 155 are substantially aligned with the slots 135 of the plates 105. The tongue 225 is then slid through the slots 135, 170 of the arms 155 and plates 105. The padlock 240 is inserted through the hole 235 of the first end 230 of the tongue 225 and locked, temporarily preventing the tongue 225 from being withdrawn from the slots 135, 170. This prevents the sleeve 150 from being removed and the plates 105 from being opened. The belt 255 is then attached around the torso (not shown) of the prisoner, and preferably, secured by a lock 285 in the back. Alternatively, the belt 255 may be secured by a buckle, clasp, hook and loop fastener, or the like.

By securing the prisoner in this way, he is prevented from accessing the keyholes 215 of the wristlets 210. The invention also prevents the prisoner from moving his hands relative to one another. By providing a means to secure the prisoner's hands to the belt 255, the invention limits a prisoner's ability to move his hands relative to his body. By providing multiple ways to secure the device by locks, the security of the prisoner restraint is enhanced.

While the invention has been described in its preferred exemplary embodiment, it is to be understood that the words that have been used are words of description rather than limitation, and that changes may be made within the purview of the appended claims without departing from the true scope and spirit of the invention in its broadest aspects. For example, the hinge 140, while desirable, is not strictly necessary to the practice of this invention. The hinge 140 may be dispensed with or may be replaced with clasps, latches, or other means of joining the longitudinal edges 120 of the plates 105. If no hinge 140 is used, additional slots 135, 170 and tongues 225 may be used to more firmly secure the plates 105. The channel 130 may be shaped in any of a variety of ways. The locking mechanisms 180 may be used in greater or less numbers, placed in different locations on the edges 120, 125 of the plates 105, may be constructed in different ways or may be dispensed with altogether. The sleeve 150 may be dispensed with altogether, in which case the tongue 225 would only pass through the slots 135 of the plates 105. Alternatively, more than one sleeve 150 may be used. The use of additional sleeves 150 enhances the security of the device 100, but increases the complexity of its use. While including a groove 145 in the longitudinal edge 120 to receive the closed end 165 of the sleeve 150 increases the stability of the device 100, the inclusion of grooves 145 is not necessary to the practice of the invention. Likewise, multiple slots 135, 170 may be used in the plates 105 and the arms 155. A corresponding increase in the number of tongues 225 may be used with the additional slots 135, 170 to provide for even greater security. However, the increase in the number of slots 135, 170 and tongues 225 further increases the complexity of the device 100. While the tongue 225 is ideally joined to the belt 255 with a chain 250, the tongue 225 may be joined directly to the belt 255 or may be attached by rope, leather thong, or any other appropriate method. The belt 255 is shown made of leather, but may be other material such as a chain, plastic or rubber. A padlock 240 inserted through the aperture 235 is shown as a preferable method of rendering the first end 230 of the tongue 225 temporarily incapable of passing through the slots 135, 170. However, other methods may be used, such as latches or clasps. Furthermore, the first end 230 of the tongue 225 need not be temporarily rendered incapable of passing through all of the slots 135, 170, so long as the tongue 225 may not be withdrawn from the arms 155 and plates 105 to the point that the device 100 may be disassembled. Thus, the slots 135, 170 need not all be the same size and shape, so long as the tongue 225 may be inserted through the slots 135, 170 when they are substantially aligned and then temporarily rendered incapable of passing back through at least one of the slots 135, 170.

What is claimed is:

1. A prisoner restraint device adapted for restraining a prisoner wearing handcuffs, comprising:

a strap having first and second ends;

a handcuff cover for covering a portion of the handcuffs;

means for connecting the strap about the prisoner such that the first and second ends are connected behind the prisoner;

plate means for connecting the handcuff cover to the handcuffs without disconnecting the strap about the prisoner; and means for connecting the plate means to the strap.

2. The prisoner restraint device of claim 1, wherein the means for connecting the plate means connects the plate means to the strap substantially equidistant the first and second ends.

3. The prisoner restraint device of claim 1, wherein the strap includes a D-ring and the means for connecting the plate means is connected to the D-ring.

4. A method for restraining a prisoner, the steps comprising:

providing a prisoner restraint strap having first and second ends, and a handcuff cover connected thereto prior to connecting the strap to the prisoner;

connecting the strap to the prisoner by connecting the first and second ends of the strap behind the prisoner; and connecting the handcuff cover to handcuffs worn by the prisoner without disconnecting the strap about the prisoner by locking a plate to the handcuff cover.

* * * * *